US008295531B2

(12) United States Patent
Lin

(10) Patent No.: US 8,295,531 B2
(45) Date of Patent: Oct. 23, 2012

(54) HEADPHONE

(75) Inventor: You-Ruei Lin, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 272 days.

(21) Appl. No.: 12/876,110

(22) Filed: Sep. 4, 2010

(65) Prior Publication Data

US 2012/0057738 A1 Mar. 8, 2012

(51) Int. Cl.
*H04R 25/00* (2006.01)

(52) U.S. Cl. ..... 381/380; 381/328; 381/370

(58) Field of Classification Search ..... 381/23.1, 381/370–376, 380, 381, 322, 324, 328, 330; 181/129, 130, 131, 135; 379/430; 455/575.2
See application file for complete search history.

(56) References Cited

U.S. PATENT DOCUMENTS 5,844,998 A * 12/1998 Nageno ..... 381/371
5,887,070 A * 3/1999 Iseberg et al. ..... 381/380
2008/0095393 A1 * 4/2008 Klein et al. ..... 381/380

* cited by examiner

*Primary Examiner* — Tuan Nguyen
(74) *Attorney, Agent, or Firm* — Lin & Associates IP, Inc.

(57) ABSTRACT

A headphone has a shell, a speaker received in the shell for making sound, a covering element fixed on the shell. A top of the shell is recessed to form a receiving cavity. A damping plate is received in the receiving cavity for separating the receiving cavity and the resonance cavity. The damping plate smoothes the frequency response of the sound pressure level in the resonance cavity while the speaker making sound, which adjusts the sound and achieves a better sound effect. It is convenient to change the damping plate. As the damping plates made of different materials have the different sound effects, users can change the damping plate for changing the sound effect. So, the user can enjoy different sound effects by only changing the damping plate.

3 Claims, 3 Drawing Sheets

HEADPHONE

BACKGROUND OF THE INVENTION

1. Field of the Invention

The present invention relates to a headphone, and more particularly to a headphone capable of changing the sound effect.

2. The Related Art

A headphone connected with a music player can help the user enjoying music and not affecting others. FIG. 3 shows a conventional headphone 100'. The headphone 100' includes a shell 10' enclosing a resonance cavity 14', a speaker 12 accommodated in the shell 10'. A top of the shell 10' has a through hole 16' interconnecting the resonance cavity 14' with the outside region. A damping plate 18' is fixed inside the shell 10' for blocking the though hole 16' in order to smoothen the frequency response of the sound pressure level in the resonance cavity 14' while the speaker 12' making sound. So, the sound effect becomes better. However, as the damping plate 18' is fixed in the shell 10, users cannot change the damping plate 18' while users want to change the sound effect. It is necessary to provide a new headphone which is capable of changing the damping plate easily, so users can enjoy different sound effects according to their own preference.

SUMMARY OF THE INVENTION

Accordingly, an object of the present invention is to provide a headphone. A headphone includes a shell, a speaker received in the shell for making sound, a covering element fixed on the shell. The shell has a top thereof recessed to form a receiving cavity. A supporting plate is formed at a bottom of the receiving cavity. A damping vent is formed at the center of the supporting plate. A damping plate received in the receiving cavity separates the receiving cavity and the resonance cavity. The covering element pressing the damping plate in the receiving cavity has a through hole going therethrough corresponding to the damping vent. The damping plate smoothes the frequency response of the sound pressure level in the resonance cavity while the speaker making sound, which adjusts the sound and achieves a better sound effect.

As described above, the damping plate separating the resonance cavity from the outside region is pressed in the receiving cavity by the covering element. It is convenient to change the damping plate. As the damping plates made of different materials have the different sound effects, users can change the damping plate to change the sound effect. So, the user can enjoy different sound effects by only changing the damping plate.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
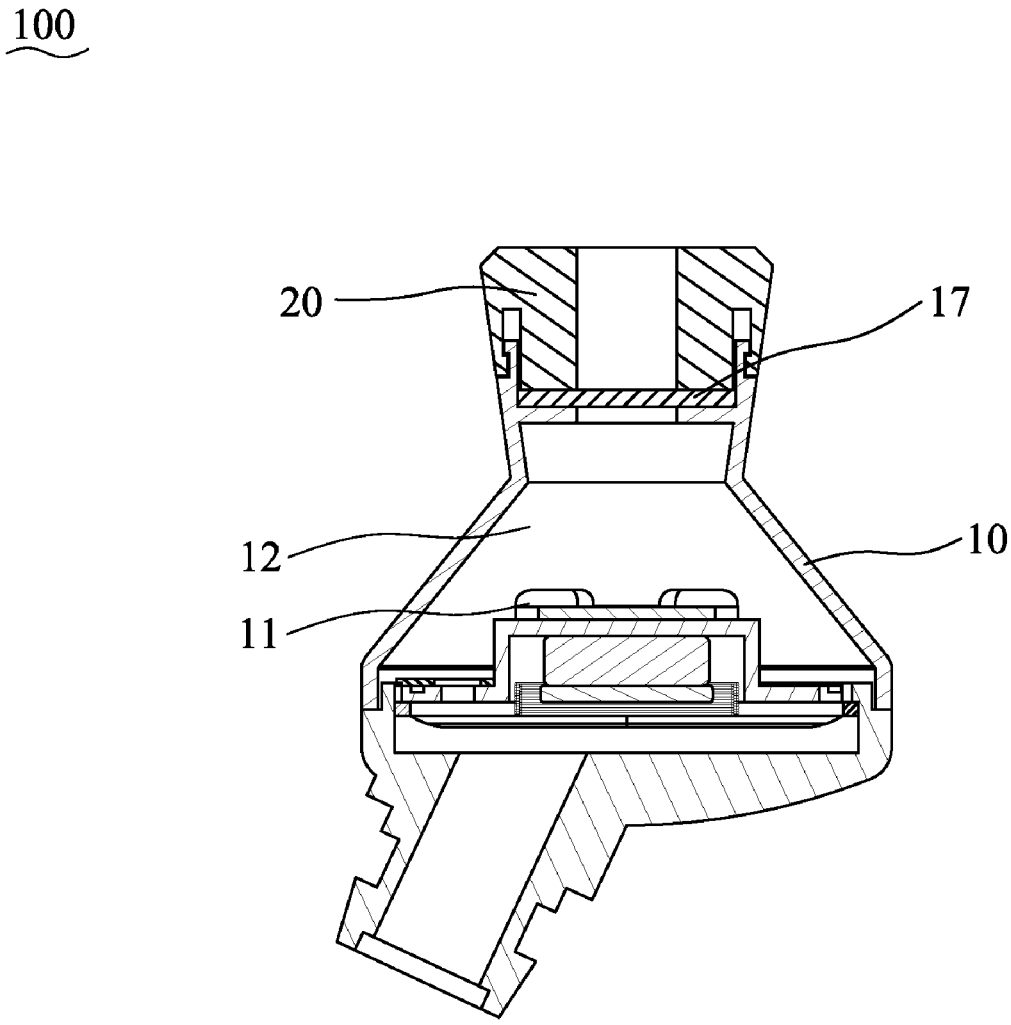
FIG. 1 is an assembled, cross-sectional view of a headphone of an embodiment in accordance with the present invention.
Figure 2:
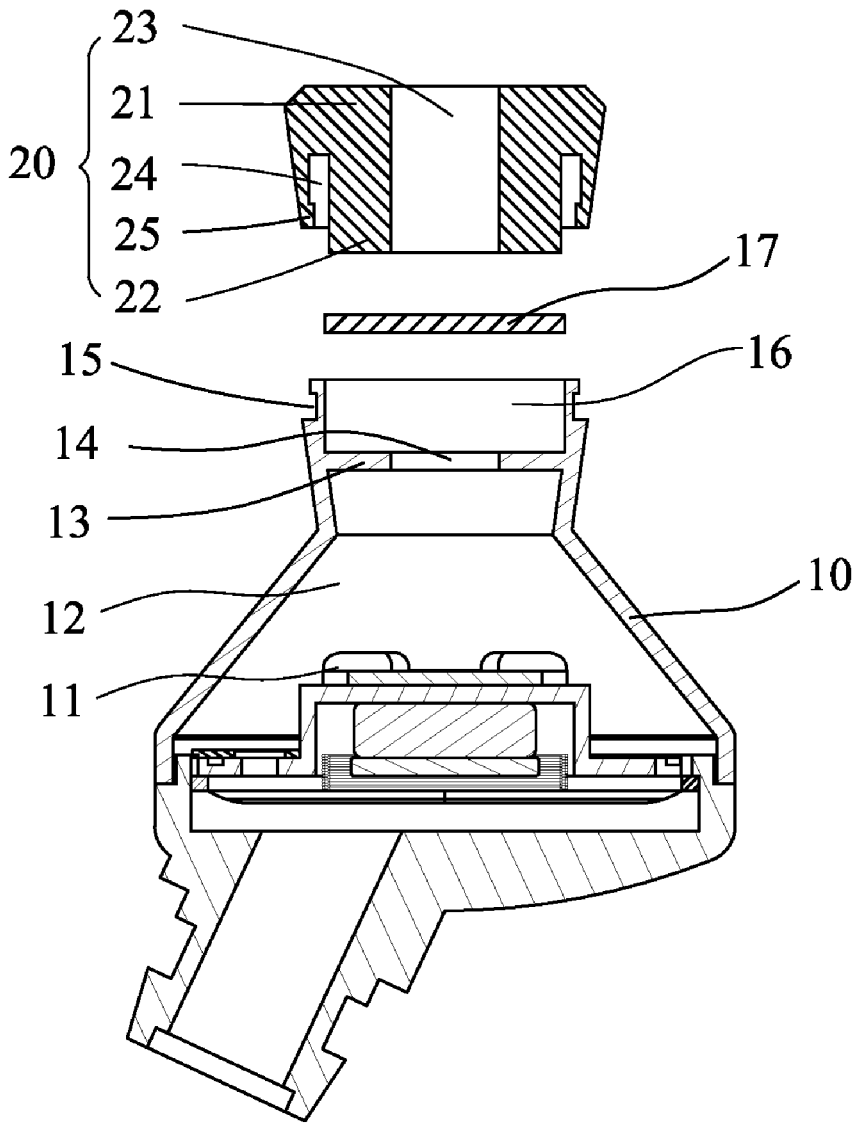
FIG. 2 is an exploded, cross-sectional view of the headphone shown in FIG. 1.
Figure 3:
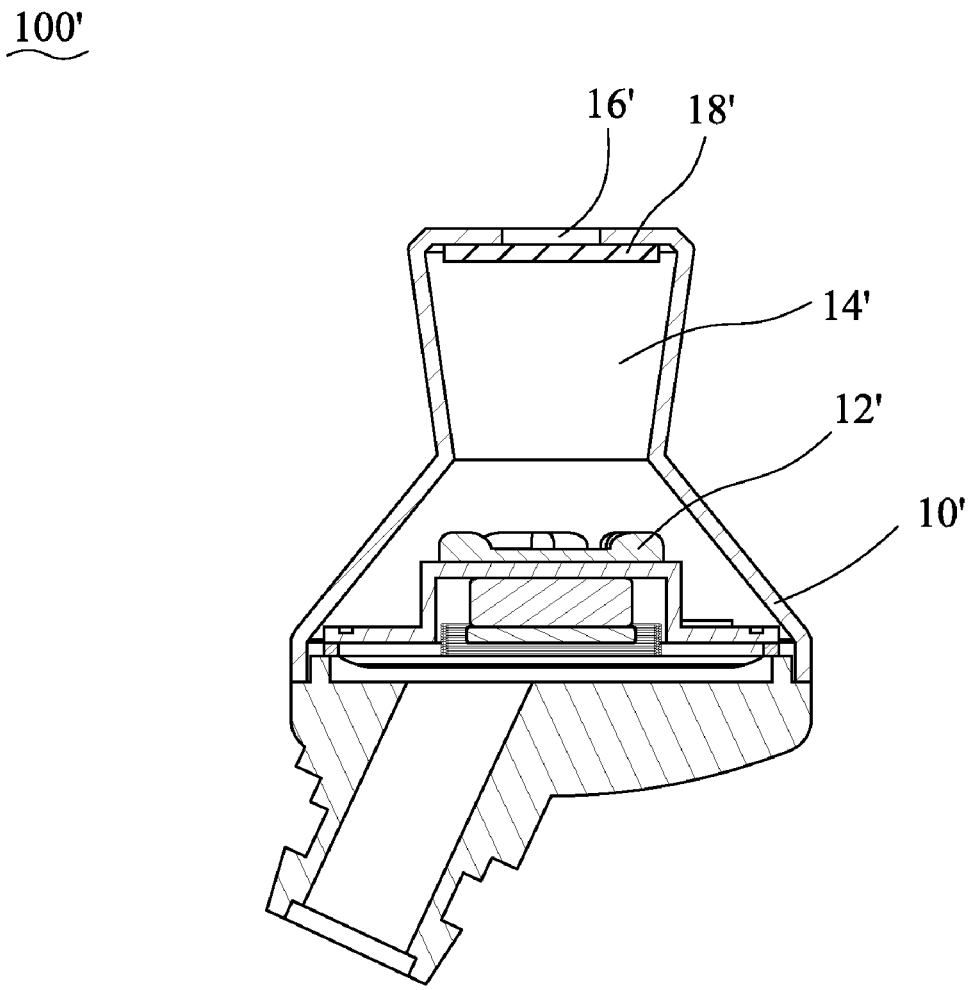
FIG. 3 (Prior Art)
FIG. 3 is a cross-sectional view of a conventional headphone.

Referring to the drawings in greater detail, and first to FIGS. 1-2, the embodiment of the invention is embodied in a headphone 100. The headphone 100 includes a shell 10, a speaker 11 accommodated in the shell 10, a covering element 20 fixed on the shell 10.

With reference to FIGS. 1-2, the shell 10 has a resonance cavity 12 at a lower portion thereof for receiving the speaker 11. A top of the shell 10 is recessed to form a receiving cavity 16. A bottom of the receiving cavity 16 forms a supporting plate 13 separating the receiving cavity 16 and the resonance cavity 12. The supporting plate 13 has a damping vent 14 formed at a center thereof The covering element 20 of column shape has a base 21. A bottom of the base 21 is extended downward to form a connecting portion 22. A center of the base 21 has a through hole 23 passing through the whole base 21 corresponding to the damping vent 14.

The covering element 20 is attached on the top of the shell 10. In this embodiment, a bottom of the connecting portion 22 is recessed to form a circle recess 24 round the connecting portion 22. A lower portion of an outer side of the circle recess 24 is extended into the circle recess 24 to form a protrusion 25. An outside surface of the top of the shell 10 is recessed to form a buckling recess 15 corresponding to the protrusion 25. In assembly, the protrusion 25 buckles with the buckling recess 15 for fixing the covering element 20 on the shell 10.

A damping plate 17 is placed on the supporting plate 13 with a top side thereof pressed by the connecting portion 22 in a mounted state of the headphone 100. The sound produced by the speaker 11 changes the pressure of the resonance cavity 12, and causes the shake of the damping plate 17. The shake of the damping plate 17 smoothens the frequency response of the sound pressure level in the resonance cavity 12, which adjusts the sound and achieves a better sound effect.

As described above, the damping plate 17 separating the resonance cavity 12 from the outside region is pressed in the receiving cavity 16 by the covering element 20. It is convenient to change the damping plate 17. As the damping plates 17 made of different materials have different sound effects, users can change the damping plate 17 for various sound effects. So, the user can experience different sound effects by only changing the damping plate 17.

What is claimed is:

1. A headphone, comprising:

a speaker for making sound;

a shell receiving the speaker having a top thereof recessed to form a receiving cavity, a supporting plate formed at a bottom of the receiving cavity, a damping vent formed at the supporting plate, a damping plate received in the receiving cavity and supported on the supporting plate to separate the receiving cavity and the resonance cavity for smoothening the frequency response of the sound pressure level in the resonance cavity while the speaker making sound; and a covering element fixed on the shell for pressing the damping plate in the receiving cavity, the covering element having a through hole going therethrough and corresponding to the damping vent.

2. The headphone as claimed in claim 1, wherein the covering element has a base, a bottom of the base is extended downward to form a connecting portion, the connecting portion is received into the receiving cavity for pressing the damping plate on the supporting plate.

3. The headphone as claimed in claim 1, wherein a bottom of the covering element is recessed to form a circle recess around the connecting portion, a lower portion of an outer side of the circle recess is extended inward to form a protrusion, the protrusion buckles with a buckling recess formed at an outside surface of the top of the shell for fixing the covering element on the shell.

* * * * *